US010647533B2

(12) United States Patent
Imai

(10) Patent No.: US 10,647,533 B2
(45) Date of Patent: May 12, 2020

(54) IMAGE FORMING SYSTEM AND IMAGE FORMING APPARATUS

(71) Applicant: CANON KABUSHIKI KAISHA, Tokyo (JP)

(72) Inventor: Yusuke Imai, Kawaguchi (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/155,937

(22) Filed: Oct. 10, 2018

(65) Prior Publication Data

US 2019/0119056 A1 Apr. 25, 2019

(30) Foreign Application Priority Data

Oct. 25, 2017 (JP) ..... 2017-206325

(51) Int. Cl.

*B65H 1/26* (2006.01)
*B65H 1/04* (2006.01)
*B65H 5/06* (2006.01)

(52) U.S. Cl.

CPC ..... *B65H 1/266* (2013.01); *B65H 1/04* (2013.01); *B65H 5/062* (2013.01); *B65H 2402/441* (2013.01); *B65H 2403/5332* (2013.01); *B65H 2404/144* (2013.01); *B65H 2601/11* (2013.01); *B65H 2801/06* (2013.01)

(58) Field of Classification Search

CPC ..... B65H 1/266; B65H 2402/441; B65H 2403/5332

USPC ..... 399/107, 110, 124, 125; 271/162

See application file for complete search history.

(56) References Cited

U.S. PATENT DOCUMENTS

| | | | | |
|---|---|---|---|---|
| 8,442,418 | B2 | 5/2013 | Koga et al. | |
| 2009/0324263 | A1* | 12/2009 | Shimizu | B65H 1/04 399/38 |
| 2013/0088762 | A1* | 4/2013 | Yamazaki | H04N 1/00543 358/498 |
| 2014/0184686 | A1* | 7/2014 | Writt | B41J 3/60 347/19 |
| 2014/0327921 | A1* | 11/2014 | Ogata | H04N 1/00572 358/1.12 |

FOREIGN PATENT DOCUMENTS

| | | | |
|---|---|---|---|
| JP | 2008-046402 | A | 2/2008 |
| JP | 2011-013299 | A | 1/2011 |

* cited by examiner

*Primary Examiner* — Thomas A Morrison
(74) *Attorney, Agent, or Firm* — Venable LLP

(57) ABSTRACT

An image forming system includes an image forming apparatus and a sheet conveyance apparatus attached detachably to the image forming apparatus. A guide guides the sheet conveyance apparatus to be attached to the image forming apparatus, and an urging portion urges a door toward a first position that is opened with respect to an apparatus body of the image forming apparatus in a case where the door is positioned at a second position opened further than the first position. The sheet conveyance apparatus includes a pressing portion to press the door positioned at the first position toward a closed position when the sheet conveyance apparatus is guided to be attached to the image forming apparatus.

9 Claims, 7 Drawing Sheets

IMAGE FORMING SYSTEM AND IMAGE FORMING APPARATUS

BACKGROUND OF THE INVENTION

Field of the Invention

The present invention relates to a sheet conveyance apparatus for conveying sheets, and an image forming apparatus and an image forming system equipped with the same.

Description of the Related Art

Generally, image forming apparatuses such as printers are provided with a door configured to open a conveyance path through which sheets are conveyed, which is used for sheet jam and for maintenance. Hitherto, a printer having a first door supported in an openable/closable manner with respect to an apparatus body of a printer, and a second door supported in an openable and closable manner with respect to the first door has been proposed (refer to Japanese Patent Application Laid-Open Publication No. 2011-13299). The first door is configured to open a conveyance path that extends in a vertical direction, and the second door is configured to open a conveyance path in the vicinity of a pivot shaft of the first door.

The second door disclosed in the above-described Japanese Patent Application Laid-Open Publication No. 2011-13299 is arranged at a lower portion of the printer, such that if a wide opening angle is ensured for the second door, accessibility to a lever used for opening and closing the second door will be deteriorated. If a small opening angle is set for the second door, space for treating sheet jam formed by opening the second door is narrowed, and the jam processing performance is deteriorated.

SUMMARY OF THE INVENTION

According to an aspect of the present invention, a sheet conveyance apparatus includes an apparatus body including a conveyance portion configured to convey a sheet, a door supported in an openable/closable manner with respect to the apparatus body around a pivot shaft, and configured to pivot to a first position that is opened with respect to the apparatus body and to a second position that is opened further with respect to the apparatus body than the first position, the door being configured to expose the conveyance portion at both the first and second positions, a pivot member pivotably supported with respect to the apparatus body around the pivot shaft, an urging portion provided between the door and the pivot member, and configured to urge the door and the pivot member to approach each other so that the door and the pivot member are pivoted integrally with respect to the apparatus body, and a regulating portion configured to regulate pivoting of the pivot member at a predetermined pivot angle with respect to the apparatus body in a case where the door is positioned at the first position, wherein the door is configured to be retained at the first position in a state where no external force is applied to the door, is pivoted relatively with respect to the pivot member against urging force of the urging portion while the door moves from the first position to the second position, and is urged toward the first position by the urging portion in a case where the door is positioned at the second position.

Further features of the present invention will become apparent from the following description of exemplary embodiments with reference to the attached drawings.

DESCRIPTION OF THE EMBODIMENTS

First Embodiment

Now, a first embodiment will be described with reference to the drawings. In the following description, positional relationships in up and down, right and left and front and rear directions are described based on the image forming apparatus viewed from a front side, that is, from the viewpoint of FIG. 1.

General Configuration of Printer

Figure 1:
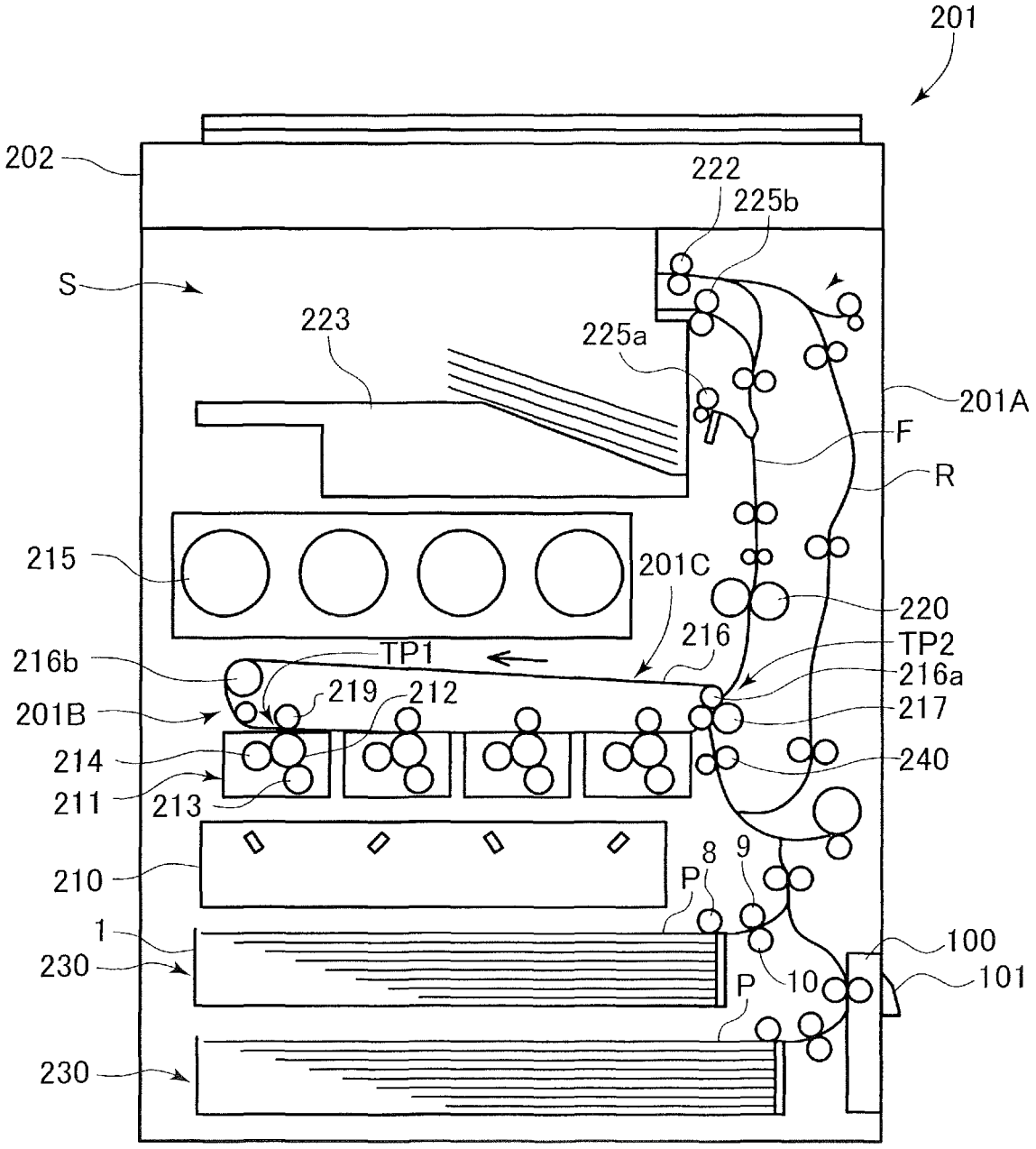
FIG. 1 is a general schematic view of a printer according to a first embodiment.

A printer 201 serving as an image forming apparatus according to the present embodiment is a full-color laser beam printer adopting an electrophotographic system. The printer 201 includes, as illustrated in FIG. 1, a printer body 201A serving as an apparatus body, and a reading unit 202 provided above the printer body 201A and reading image data from a document.

The printer body 201A includes an image forming portion 201B for forming an image on a sheet P, and a fixing unit 220 configured to fix the image on the sheet P. Between the reading unit 202 and the printer body 201A is formed a discharge space S to which the sheet P is discharged, and a sheet discharge tray 223 on which the discharged sheet P is supported is provided in the discharge space S. Further, the printer body 201A is provided with a plurality of (two, according to the present embodiment) cassette sheet feeding devices 230 configured to feed sheets P to the image forming portion 201B, and a door 100 supported in an openable/closable manner with respect to the printer body 201A. The door 100 is arranged lower than the image forming portion 201B. Each cassette sheet feeding device 230 includes a cassette 1 that stores sheets P, a pickup roller 8 serving as a conveyance portion for conveying sheets P, a feed roller 9 and a retard roller 10 that separate and convey the sheets P one by one.

The image forming portion 201B is a so-called four-drum full-color image forming portion including a laser scanner 210, four process cartridges 211, and an intermediate transfer unit 201C. The process cartridges form toner images of respective colors, which are yellow (Y), magenta (M), cyan (C) and black (K). The respective process cartridges 211 include a photosensitive drum 212, a charging unit 213, a developing unit 214, a cleaner not shown, and so on. A toner cartridge 215 that stores toner of each color is attached in a detachable manner to the printer body 201A above the image forming portion 201B.

The intermediate transfer unit 201C includes an intermediate transfer belt 216 wound around a drive roller 216*a* and a tension roller 216*b*, and the intermediate transfer belt 216 is arranged above the four process cartridges 211. The intermediate transfer belt 216 is arranged to contact the photosensitive drum 212 of the respective process cartridges 211 and driven to rotate in a counterclockwise direction by the drive roller 216*a* that is driven by a driving unit not shown. The intermediate transfer unit 201C includes primary transfer rollers 219 that contact an inner circumferential surface of the intermediate transfer belt 216 at positions opposing to respective photosensitive drums 212, and a primary transfer portion TP1 is formed as a nip portion between the intermediate transfer belt 216 and the photosensitive drum 212. Further, the image forming portion 201B includes a secondary transfer roller 217 that contacts an outer circumferential surface of the intermediate transfer belt 216 at a position opposed to the drive roller 216*a*. A secondary transfer portion TP2 is formed as a nip portion between the secondary transfer roller 217 and the intermediate transfer belt 216 where toner image borne on the intermediate transfer belt 216 is transferred to the sheet P.

In the respective process cartridges 211 configured as above, an electrostatic latent image is formed on the surface of the photosensitive drum 212 by a laser scanner 210, and toner is supplied from the developing unit 214, by which toner images of respective colors charged to negative polarity are formed. The toner images are sequentially transferred at the respective primary transfer portions TP1 to the intermediate transfer belt 216 in multiple layers by applying transfer bias voltage of positive polarity to the primary transfer roller 219, and a full-color toner image is formed on the intermediate transfer belt 216.

In parallel with the image forming process, the sheet P fed from the cassette sheet feeding device 230 is conveyed toward a registration roller pair 240, and the registration roller pair 240 corrects skewing of the sheets. The registration roller pair 240 conveys the sheet P to the secondary transfer portion TP2 at a matched timing with a transfer timing of the full-color toner image formed on the intermediate transfer belt 216. The toner image borne on the intermediate transfer belt 216 is secondarily transferred to the sheet P at the secondary transfer portion TP2 by having the transfer bias voltage of positive polarity applied to the secondary transfer roller 217.

The sheet P to which toner image has been transferred is heated and pressed at the fixing unit 220, by which the color image is fixed to the sheet P. The sheet P having the image fixed thereto is discharged through a first sheet discharge roller pair 225*a* or a second sheet discharge roller pair 225*b* to the sheet discharge tray 223 and supported thereon. If images are to be formed on both sides of the sheet P, the sheet P is passed through the fixing unit 220 and switched back by a reverse conveyance roller pair 222 that is capable of rotating in normal and reverse directions. Then, the sheet P is re-conveyed to the secondary transfer portion TP2 through a re-conveyance path R, and an image is formed on a rear side thereof.

Opening/Closing Configuration of Door

Figure 2A:
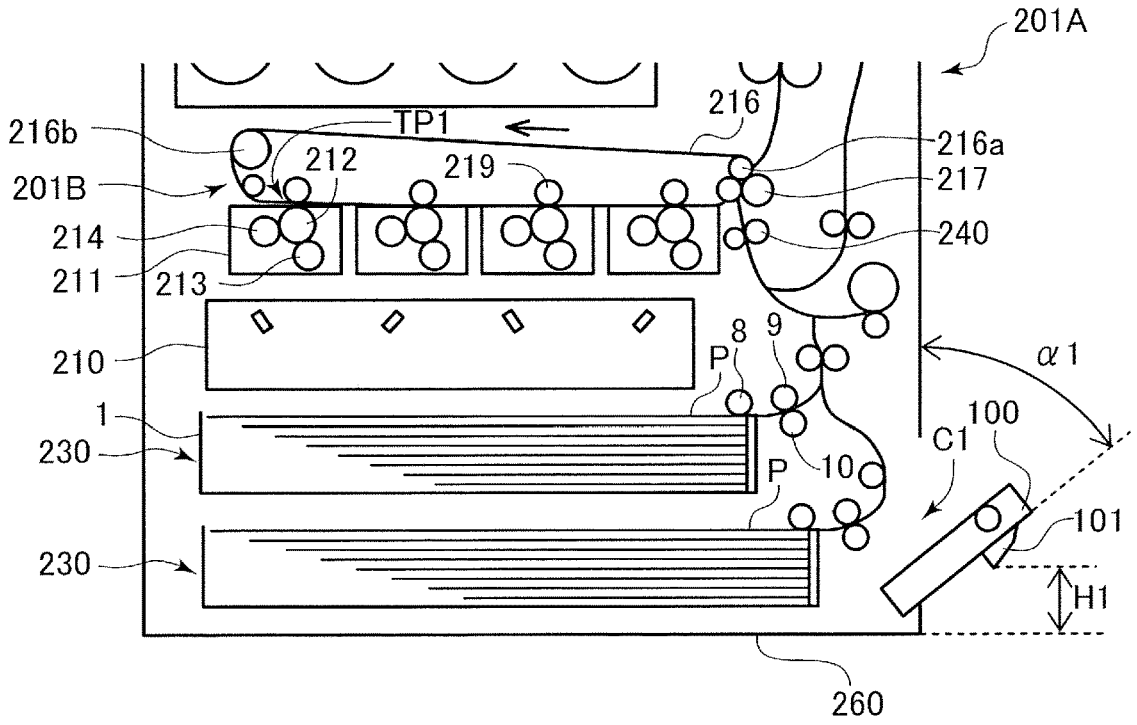
FIG. 2A is a schematic diagram illustrating a state in which a door is positioned at a first position.
Figure 2B:
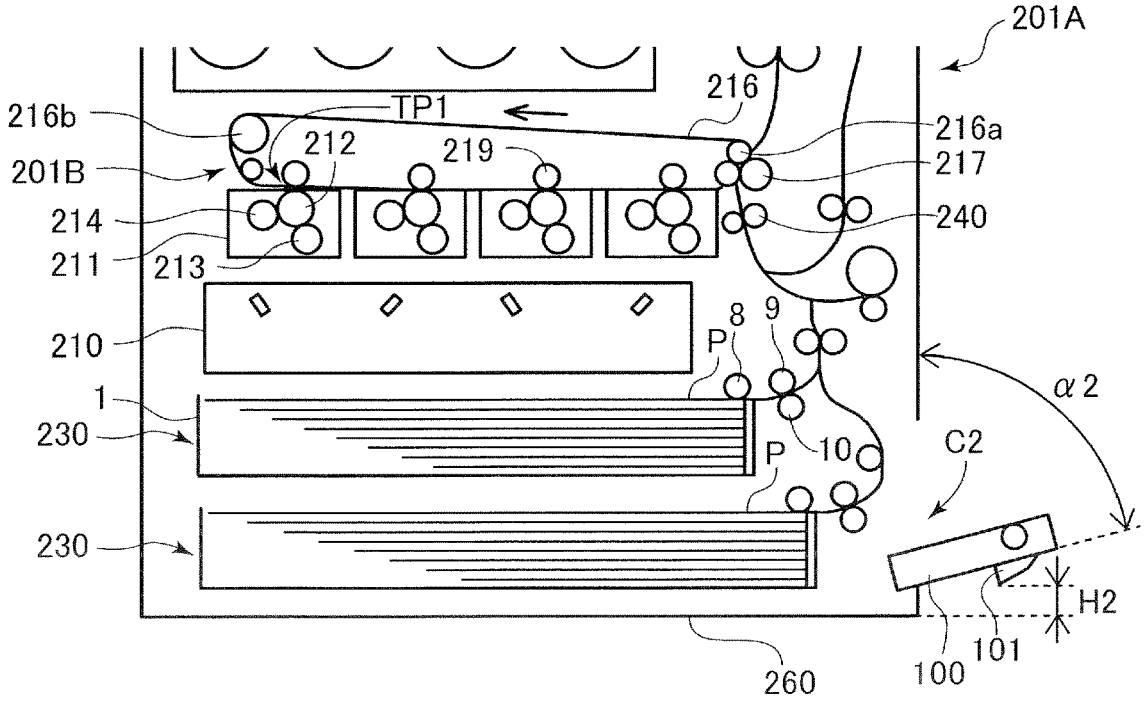
FIG. 2B is a schematic diagram illustrating a state in which the door is positioned at a second position.
Figure 3A:
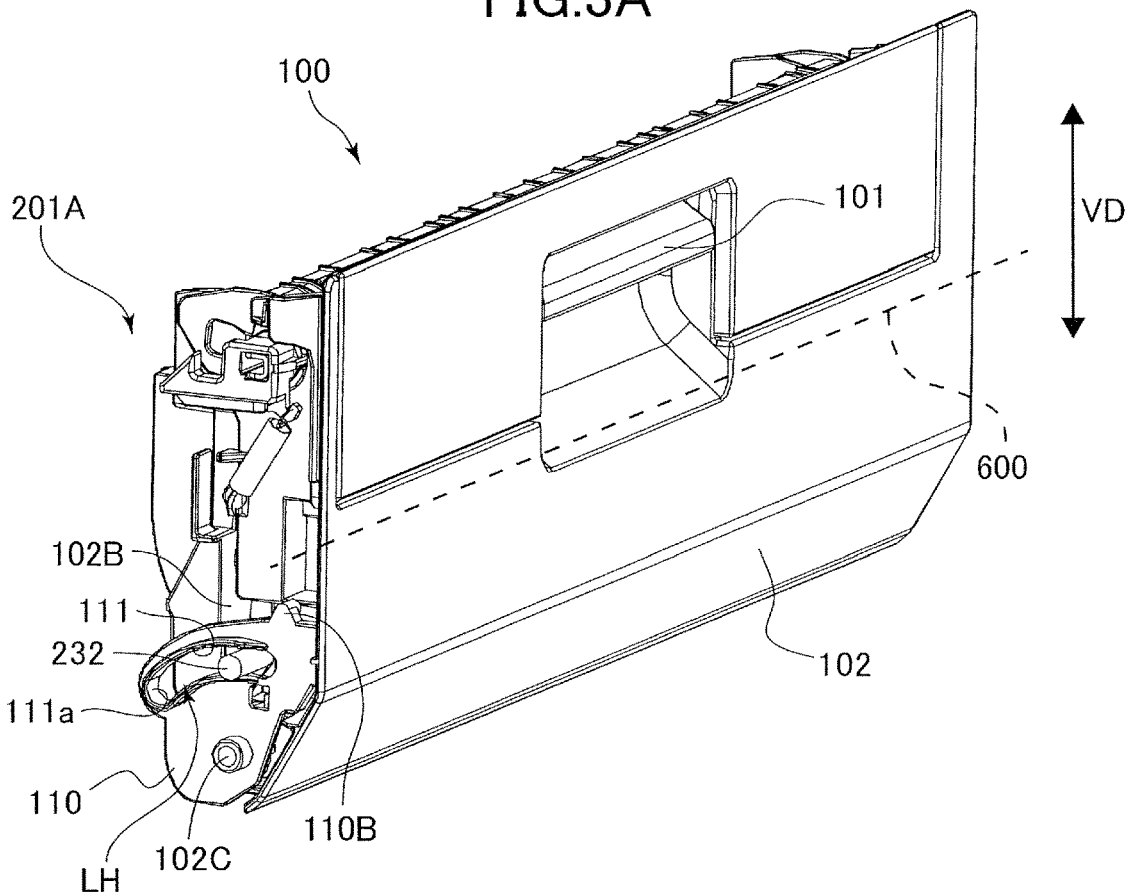
FIG. 3A is a perspective view illustrating the door and a pivot member.

As illustrated in FIG. 3A, the door 100 is supported pivotably with respect to the printer body 201A around a pivot shaft 102C and includes a handle 101 that a user uses to open and close the door 100, and a door cover 102 constituting an exterior of the printer body 201A. The pivot shaft 102C is positioned lower than a center position 600 of the door 100 in a vertical direction VD, and the handle 101 is positioned higher than the center position 600. The door 100 may include a lock mechanism for locking the door with respect to the printer body 201A in a state where the door 100 is closed, and the lock mechanism may be configured to enable the lock of the lock mechanism to be unlocked when the user operates the handle 101. The door 100 may be opened to a first position in which the door is opened to a first angle $\alpha 1$ with respect to the printer body 201A, as illustrated in FIG. 2A, and a second position in which the door is opened to a second angle $\alpha 2$ with respect to the printer body 201A, as illustrated in FIG. 2B. Preferably, the angle of $\alpha 1$ is between 45° and 60° and the angle of $\alpha 2$ is between 70° and 90°, and in the present embodiment, $\alpha 1=60°$ and $\alpha 2=80°$.

The second angle $\alpha 2$ is greater than the first angle $\alpha 1$ ($\alpha 2>\alpha 1$), and a processing space C2 between the door 100 positioned at the second position and the printer body 201A is greater than a processing space C1 between the door 100 positioned at the first position and the printer body 201A. Therefore, jamming of sheets can be treated more easily and jam processing performance is improved when the door 100 is positioned at the second position than at the first position.

Meanwhile, a height H1 from a bottom surface 260 of the printer body 201A to the handle 101 of the door 100 positioned at the first position is higher than a height H2 from the bottom surface 260 to the handle 101 of the door 100 positioned at the second position. Therefore, the user can access the handle 101 more easily when the door 100 is positioned at the first position than when it is positioned at the second position, and the user can operate the door 100 easily by holding the handle 101. That is, the accessibility is higher when the door 100 is positioned at the first position.

Figure 3B:
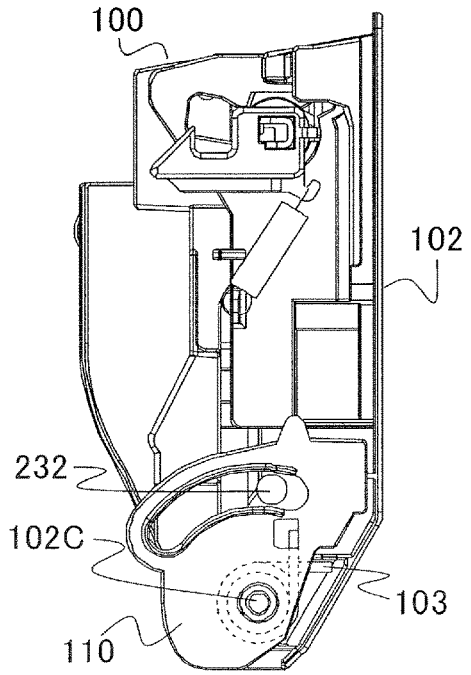
FIG. 3B is a side view illustrating the door, the pivot member and an urging spring.
Figure 3C:
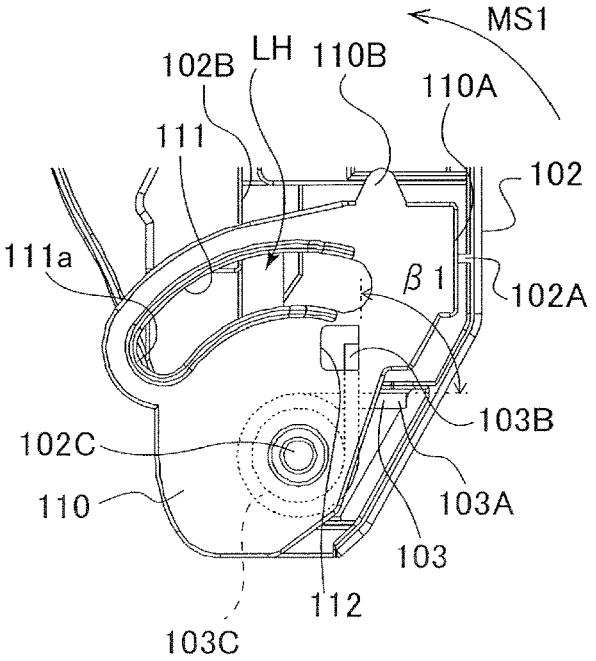
FIG. 3C is an enlarged side view illustrating the door, the pivot member and the urging spring.

As illustrated in FIGS. 3A through 3C, a pivot member 110 is pivotably supported on the pivot shaft 102C, and the pivot member 110 serving as a pivot member includes a long hole portion 111 that constitutes a long hole LH extending in an arc shape in a circumferential direction around the pivot shaft 102C. A stopper 232 serving as a projection protruded from the printer body 201A is passed through the long hole LH, and pivoting of the pivot member 110 is restricted by the stopper 232 being in contact with an end portion 111*a* of the long hole portion 111 in the circumferential direction. That is, the long hole portion 111 and the stopper 232 constitute a regulating portion 70 that regulates pivoting of the pivot member 110 at a predetermined pivot angle with respect to the printer body 201A. Further, the pivot member 110 includes a second abutment portion 110B that serves as a third contact portion capable of abutting against a first abutment portion 102B of the door cover 102. The door 100 is regulated from opening beyond than the second position in a state where the first abutment portion 102B abuts against the second abutment portion 110B while the pivot member 110 is in contact with the end portion 111*a* of the long hole portion 111.

A coil portion 103C of an urging spring 103 composed of a torsion spring is wound around the pivot shaft 102C, wherein a first end 103A of the urging spring 103 is connected to the door cover 102 of the door 100 and a second end 103B thereof is connected to a hole portion 112 formed to the pivot member 110. As illustrated in FIG. 3C, in a state where the door 100 is closed with respect to the printer body 201A, a first contact portion 102A of the door cover 102 is in contact with a second contact portion 110A of the pivot member 110. In this state, the urging spring 103 serving as an urging portion is positioned such that a torsional angle formed by the first end 103A and the second end 103B is set to angle β1 and generates a moment MS1 toward a direction in which the torsional angle becomes smaller. That is, the urging spring 103 urges the door 100 and the pivot member 110 so as to approach each other such that the door 100 and the pivot member 110 are pivoted integrally with respect to the printer body 201A. More specifically, the urging spring 103 urges the door 100 and the pivot member 110 such that the first contact portion 102A of the door cover 102 and the second contact portion 110A of the pivot member 110 approach each other. It is also possible to arrange a buffer material or other members to be intervened between the first contact portion 102A and the second contact portion 110A. It is noted that the printer body 201A, the door 100, the pivot member 110, the urging spring 103 and so on constitute a sheet conveyance apparatus and a first sheet conveyance apparatus.

Opening Operation and Retaining Configuration of Door

Figure 4A:
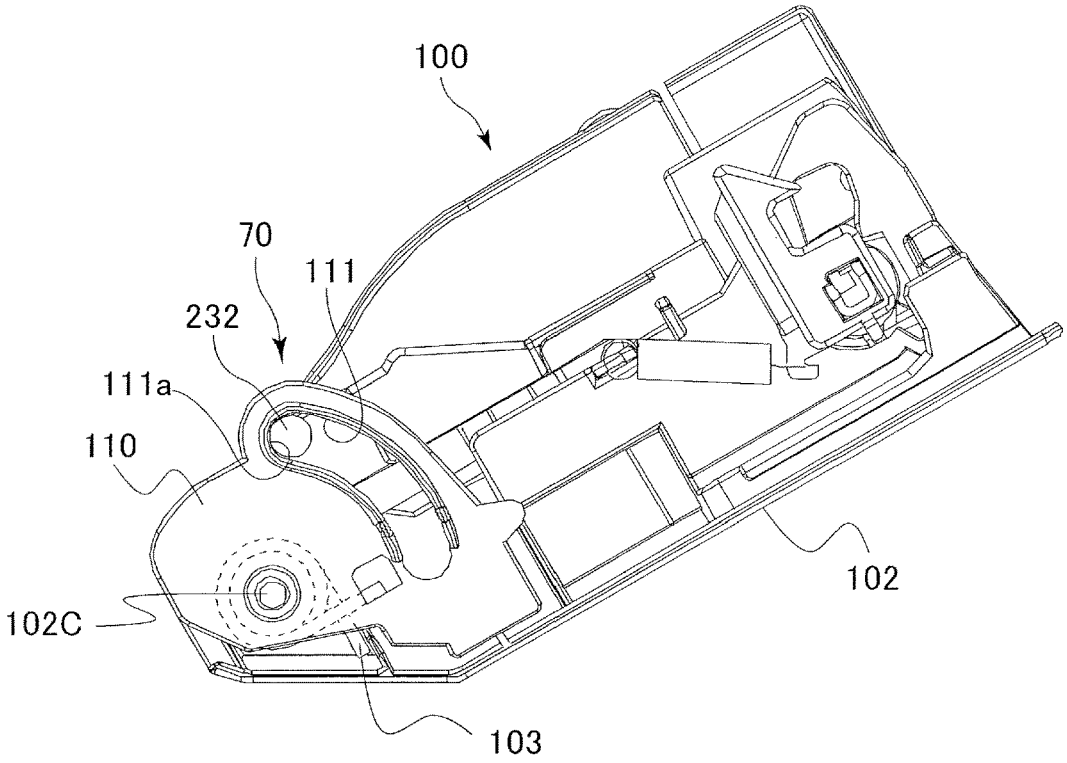
FIG. 4A is a side view illustrating the door and the pivot member positioned at a first position.
Figure 4B:
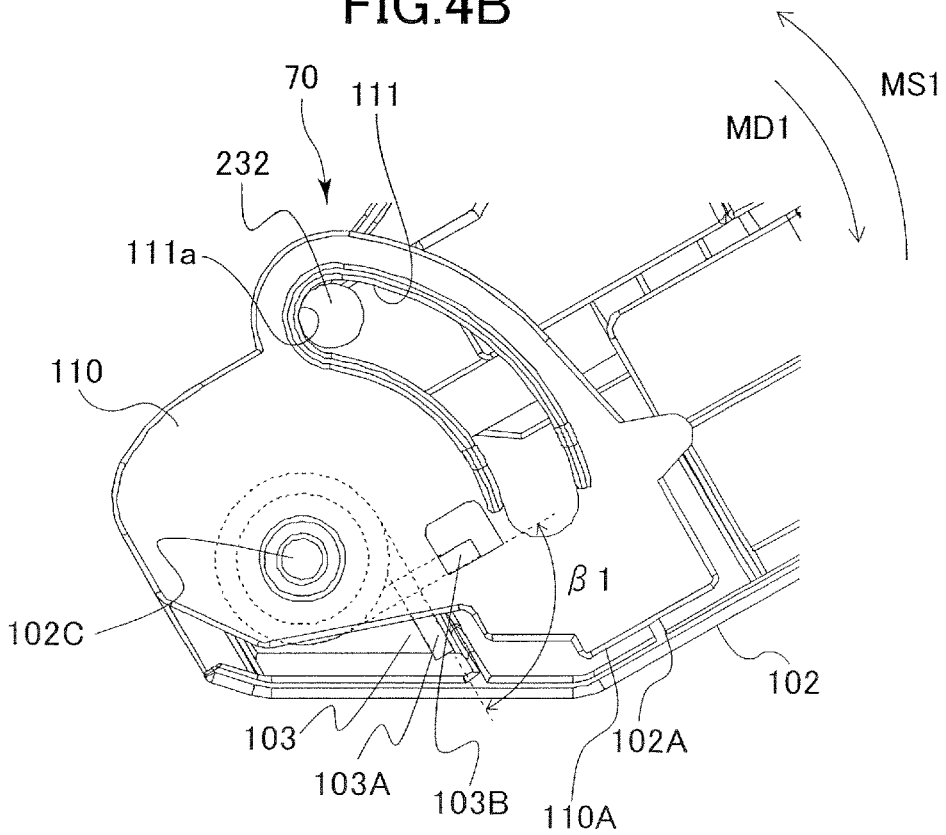
FIG. 4B is an enlarged side view illustrating the door and the pivot member positioned at the first position.

Next, an opening operation and retaining configuration of the door 100 will be described. As illustrated in FIGS. 4A and 4B, if the user holds the handle 101 (refer to FIG. 3A) serving as a handle portion and opens the door 100, the pivot member 110 pivots together with the door 100 around the pivot shaft 102C by the action of the urging spring 103. In this state, the first contact portion 102A of the door cover 102 and the second contact portion 110A of the pivot member 110 maintain contact.

If the door 100 is opened to the first position, the stopper 232 contacts the end portion 111*a* of the long hole portion 111 formed on the pivot member 110. Thereby, the pivot member 110 is regulated from pivoting in an opening direction beyond the predetermined pivot angle. In this state, as illustrated in FIG. 4B, a moment MD1 generated by own weight of the door 100 in a direction opening the door 100 and the moment MS1 generated by the urging spring 103 in a direction closing the door 100 are applied to the door 100. The moment MS1 is set greater than the moment MD1 (MS1>MD1), and the first and second contact portions 102A and 110A are in contact, so the door 100 is retained at the first position. That is, the door 100 is retained at the first position unless external force is applied, that is, if the user or the like does not touch the door.

Figure 5A:
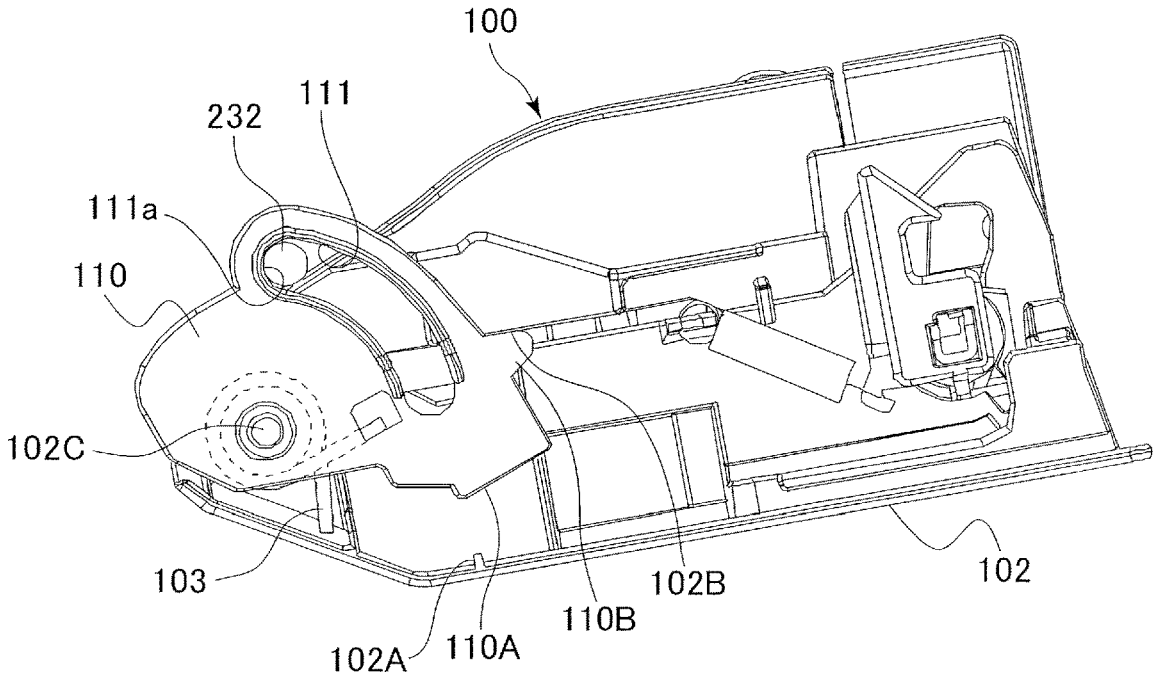
FIG. 5A is a side view illustrating the door and the pivot member positioned at a second position.
Figure 5B:
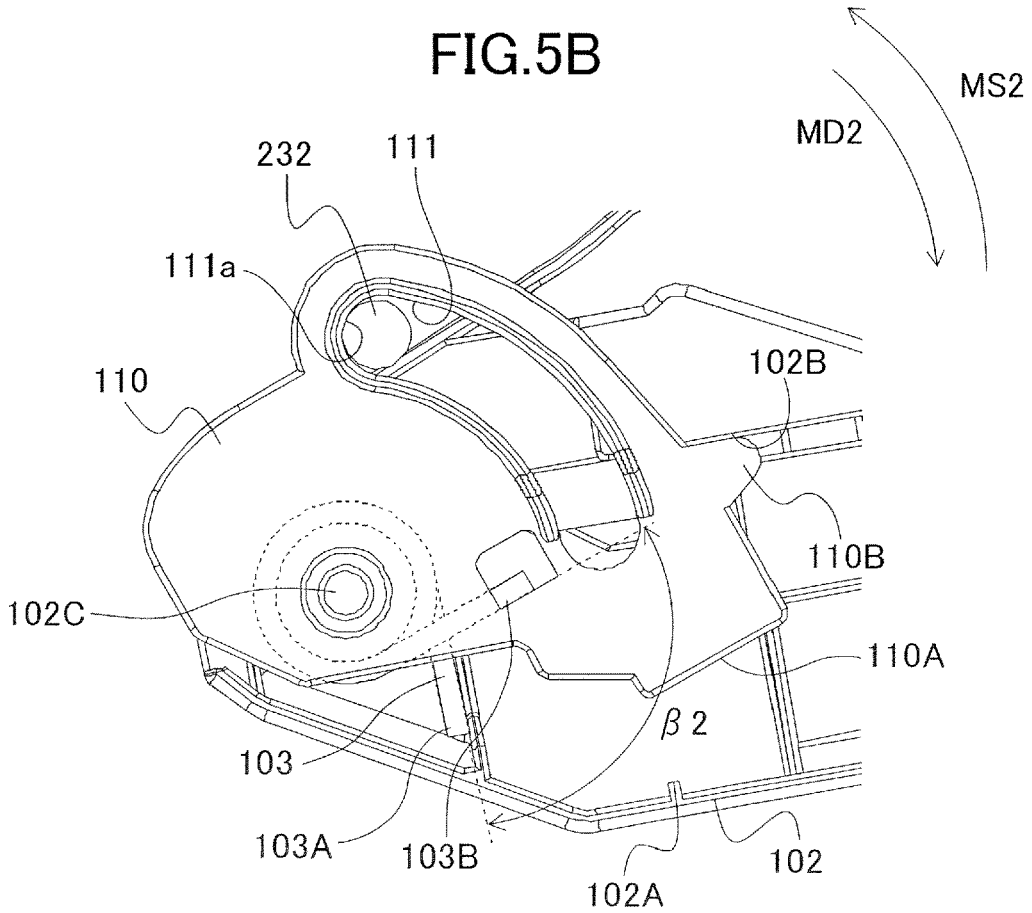
FIG. 5B is an enlarged side view illustrating the door and the pivot member positioned at the second position.

FIGS. 5A and 5B illustrate a state in which the door 100 is opened further by the user from the first position and is positioned at the second position. When the door 100 moves from the first position to the second position, the stopper 232 maintains contact with the end portion 111*a* of the long hole portion 111 formed on the pivot member 110, and the pivot member 110 will not pivot. That is, the pivot member 110 is regulated from pivoting by the regulating portion 70 including the stopper 232 and the long hole portion 111 in a state where it is positioned at the first and second positions. With respect to the pivot member 110 maintaining the stopped state, the door 100 relatively pivots against the urging force of the urging spring 103, and the first contact portion 102A is separated from the second contact portion 110A. Thereby, the torsional angle formed by the first end 103A and the second end 103B of the urging spring 103 is β2 which is greater than the angle β1 (β2>β1). Further, as illustrated in FIG. 5B, the opening angle of the door 100 is regulated to the second angle α2 (refer to FIG. 2) by the first abutment portion 102B of the door cover 102 abutting against the second abutment portion 110B of the pivot member 110.

In a state where the door 100 is positioned at the second position, a moment MD2 generated by the own weight of the door 100 in the direction opening the door 100 and a moment MS2 generated by the urging spring 103 in the direction closing the door 100 are applied to the door 100. The moment MS2 is set greater than the moment MD2 (MS2>MD2), and the first and second contact portions 102A and 110A are separated, such that the door 100 attempts to return to the first position. Therefore, if the user removes his/her hand from the door 100, the door 100 returns to the first position by urging force of the urging spring 103.

According to this configuration, even if the user removes his/her hand from the door 100, the door 100 will be retained at the first position, as illustrated in FIG. 2A. Thereby, the height from the bottom surface 260 of the printer body 201A to the handle 101 will be set to height H1, and the user can easily access the handle 101. Therefore, usability can be improved.

As illustrated in FIG. 2B, in a state where the user opens the door 100 to the second position against the urging force of the urging spring 103, a wide processing space C2 can be ensured between the door 100 and the printer body 201A, and the jam processing performance can be improved. Thereby, the accessibility to the door 100 and the jam processing performance can be realized at the same time.

When the user opens the door 100 from the closed state to the first position, the user must operate the handle 101, but once the door 100 is opened to the first position, the user can push the door 100 to be opened to the second position without operating the handle 101. If the user removes his/her hand from the door 100 positioned at the second position, the door 100 is returned to the first position by the urging spring 103, and the door 100 can be closed easily, such that the operation performance of the door 100 is improved.

External Sheet Conveyance Apparatus

Figure 6A:
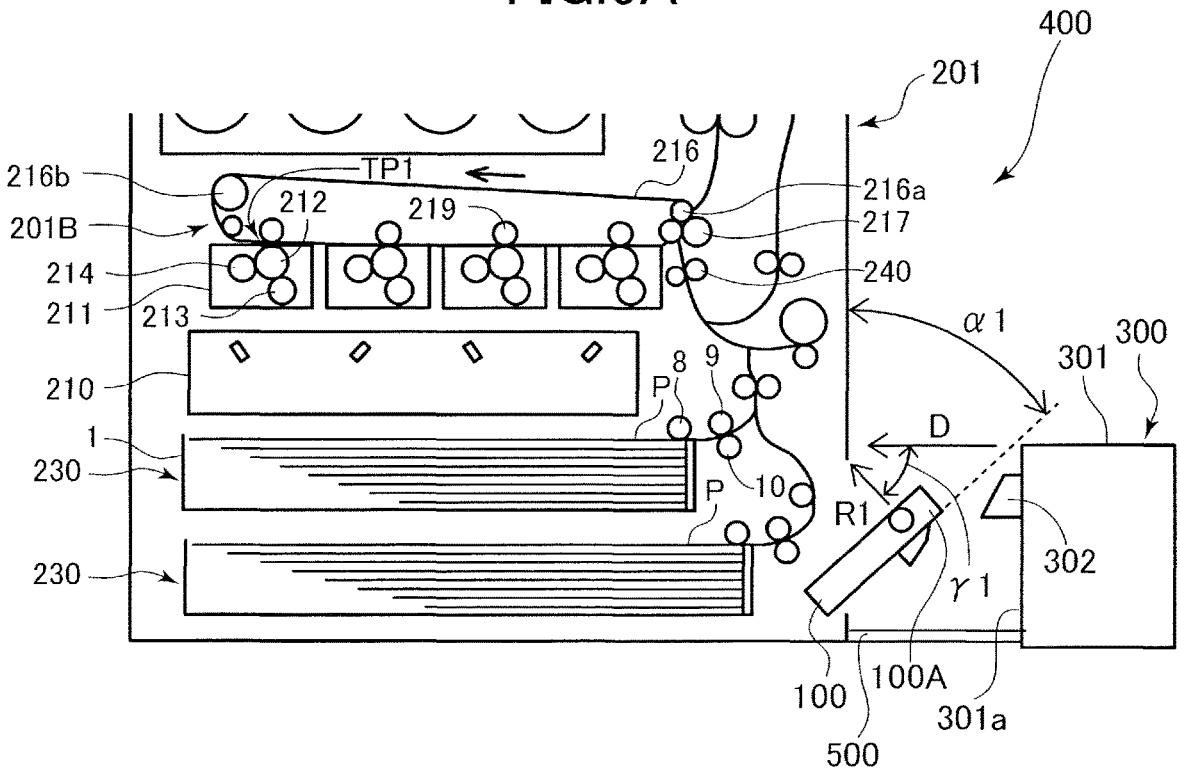
FIG. 6A is a schematic diagram illustrating the door and an external sheet conveyance apparatus positioned at the first position.
Figure 6B:
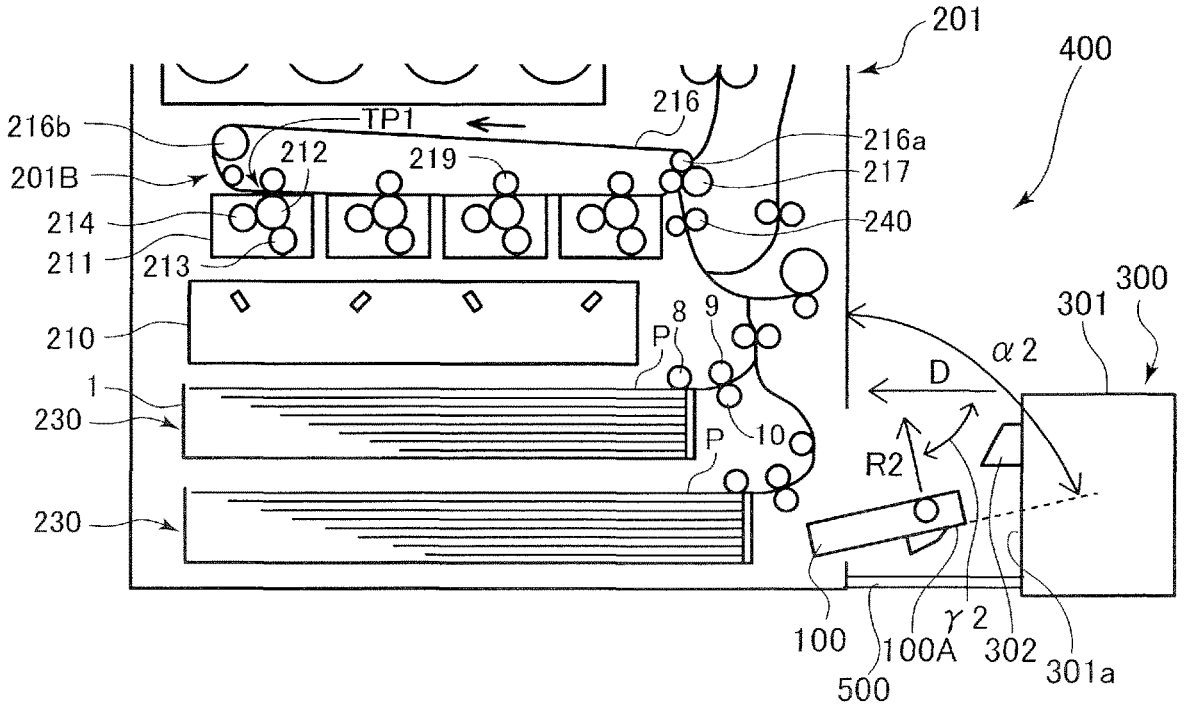
FIG. 6B is a schematic diagram illustrating the door and the external sheet conveyance apparatus positioned at the second position.

As illustrated in FIGS. 6A and 6B, an external sheet conveyance apparatus 300 serving as a second conveyance apparatus can be connected detachably to the printer 201, and the printer 201 and the sheet conveyance apparatus 300 constitute an image forming system 400. In order to connect the sheet conveyance apparatus 300 to the printer 201, a guide 500 is attached to the printer 201. The sheet conveyance apparatus 300 is guided by the guide 500 from the side of the printer 201 in which the door 100 is positioned, moved to the direction of arrow D and connected to the printer 201. The sheet conveyance apparatus 300 includes a housing 301 and a pressing portion 302 that protrudes from a side surface 301*a* of the housing 301.

As illustrated in FIG. 6A, in a state where the door 100 is positioned at the first position opened at the first angle α1, the pressing portion 302 is capable of pressing an upper portion 100A of the door 100 to close the door. That is, the pressing portion 302 of the sheet conveyance apparatus 300 can press and close the door 100 while the sheet conveyance apparatus 300 is being connected to the printer 201. In a state where the door 100 is positioned at the first position, an angle formed by the arrow D direction indicating the direction of movement of the sheet conveyance apparatus 300 and a direction R1 in which the door 100 closes is angle γ1.

Meanwhile, as illustrated in FIG. 6B, in a state where the door 100 is positioned at a second position opened to a second angle α2, the upper portion 100A of the door 100 is positioned below the pressing portion 302. Therefore, even if the sheet conveyance apparatus 300 is moved in the arrow D direction, the pressing portion 302 will not contact the upper portion 100A. In a state where the door 100 is positioned at the second position, an angle formed by the arrow D direction indicating the direction of movement of the sheet conveyance apparatus 300 and a direction R2 in which the door 100 closes is angle γ2, which is greater than γ1 (γ2>γ1).

As described, as the angle formed by the arrow D direction and the direction R2 in which the door closes increases and approximates 90°, it becomes difficult for the sheet conveyance apparatus 300 to close the door 100. According to the present embodiment, even if the door 100 is opened by the user, it is retained at the first position as illustrated in FIG. 6A, so the door 100 can be closed by the pressing portion 302 of the sheet conveyance apparatus 300. Therefore, even if the user forgets to close the door 100 when the user connects the sheet conveyance apparatus 300 to the printer 201, the door 100 will be closed by the pressing portion 302, such the pressing portion 302 functions as a foolproof portion in case the user forgets to close the door 100.

In a state where the door 100 is positioned at the first position, the angle formed by the arrow D direction and the direction R2 in which the door 100 closes is relatively small, and the door 100 can be closed easily. Furthermore, the possibility of the sheet conveyance apparatus 300 colliding strongly against the door 100 and causing damage to the door 100 or the sheet conveyance apparatus 300 can be reduced.

Second Embodiment

Next, a second embodiment of the present invention will be described. Compared to the first embodiment, the second embodiment changes the positional relationship of the stopper, the door and the pivot member, and the urging force of the urging spring. Therefore, the components similar to the first embodiment are either not shown in the drawing or denoted with the same reference numbers.

Figure 7A:
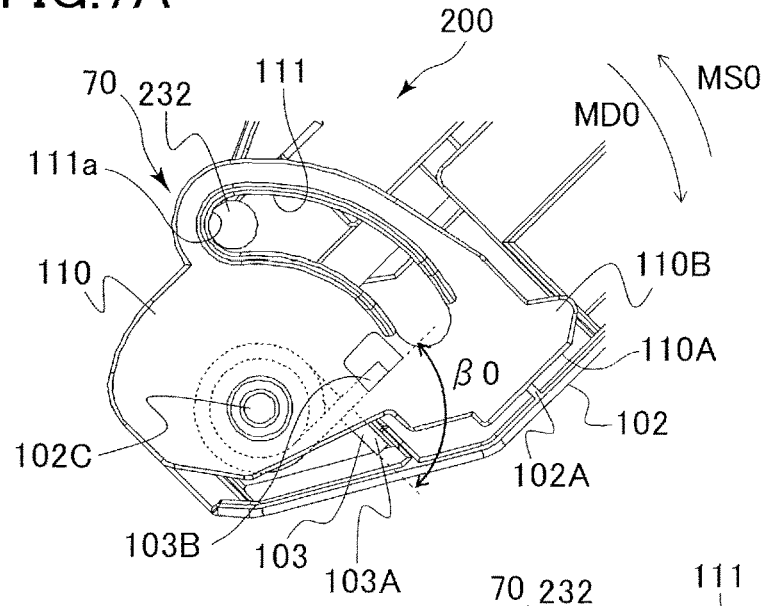
FIG. 7A is a side view of a door, a pivot member and an urging spring positioned at a third position according to a second embodiment.
Figure 7B:
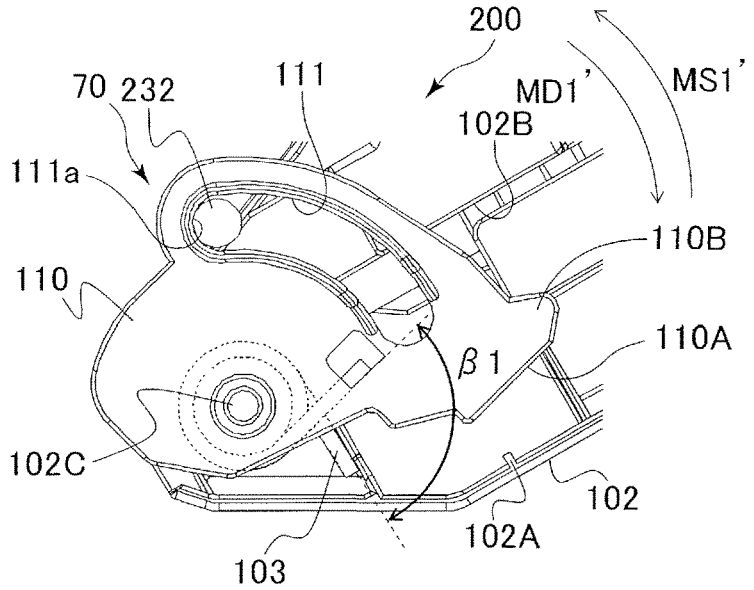
FIG. 7B is a side view of the door, the pivot member and the urging spring positioned at a first position.
Figure 7C:
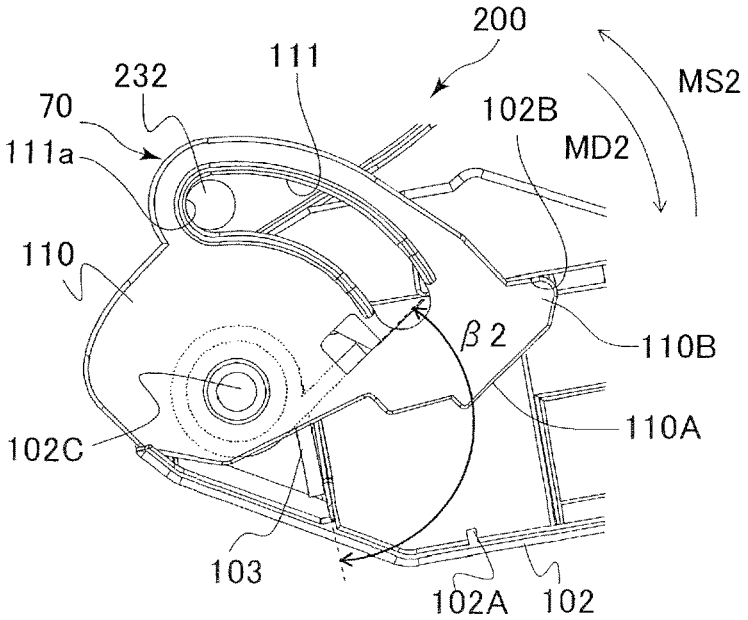
FIG. 7C is a side view of the door, the pivot member and the urging spring positioned at a second position.

FIG. 7A is a side view illustrating a door 200 and the pivot member 110 positioned at a third position that is closer to a closed position with respect to the printer body 201A (refer to FIG. 2) than the first position. In the third position, the door 200 is opened to a third angle α3 that is smaller than the first angle α1 with respect to the printer body 201A (α1>α3). FIG. 7B is a side view illustrating the door 200 in the first position and the pivot member 110, and FIG. 7C is a side view illustrating the door 200 in the second position and the pivot member 110. That is, as the door 200 opens, the door 200 is transited to the third position (position illustrated in FIG. 7A), the first position (position illustrated in FIG. 7B) and the second position in the named order (position illustrated in FIG. 7C).

In a state where the door 200 is opened to the third position, as illustrated in FIG. 7A, the stopper 232 contacts the end portion 111*a* of the long hole portion 111 formed on the pivot member 110. Thereby, pivoting movement of the pivot member 110 to the opening direction is regulated. In this state, a moment MD0 generated by the own weight of the door 200 in a direction opening the door 200 and a moment MS0 generated by the urging spring 103 in a direction closing the door 200 are applied to the door 200. The moment MD0 is set greater than the moment MS0 (MD0>MS0), and the door 200 is pivoted by its own weight toward the first and second positions. In a state where the door 200 is positioned at the third position, the torsional angle formed by the first end 103A and the second end 103B of the urging spring 103 is β0 that is smaller than angle β1 (β0<β1).

When the door 200 moves from the third position to the first position, as illustrated in FIG. 7B, the stopper 232 maintains contact with the end portion 111*a* of the long hole portion 111 formed on the pivot member 110, and the pivot member 110 does not pivot. With respect to the pivot member 110 maintaining a stopped state, the door 200 pivots relatively against the urging force of the urging spring 103, and the first contact portion 102A separates from the second contact portion 110A. Thereby, the torsional angle formed by the first end 103A and the second end 103B of the urging spring 103 will be β1, which is greater than angle β0.

In a state where the door 200 reaches the first position, a moment MD1' generated by the own weight of the door 200 in a direction opening the door 200 and a moment MS1' generated by the urging spring 103 in a direction closing the door 200 are applied to the door 200. Moment MS1' is set to be equal to moment MD1', and the balance between these moments maintains the door 200 at the first position.

As illustrated in FIG. 7C, in a state where the door 200 is further opened by the user from the first position to the second position, the first contact portion 102A of the door 200 separates further from the second contact portion 110A of the pivot member 110. When the door is positioned at the third position, the first position and the second position, the pivot member 110 is regulated from pivoting by the regulating portion 70 including the stopper 232 and the long hole portion 111. Thereby, the torsional angle formed by the first end 103A and the second end 103B of the urging spring 103 will be β2, which is greater than angle β1. Further, since the first abutment portion 102B of the door cover 102 abuts against the second abutment portion 110B of the pivot member 110, an opening angle of the door 200 is regulated to a second angle α2 (refer to FIG. 2).

In a state where the door 200 is positioned at the second position, a moment MD2 generated by the own weight of the door 200 in a direction opening the door 200 and a moment MS2 generated by the urging spring 103 in a direction closing the door 200 are applied to the door 200. The moment MS2 is set greater than the moment MD2 (MS2>MD2), and the first and second contact portions 102A and 110A are separated, such that the door 200 attempts to return to the first position. Therefore, if the user removes his/her hand from the door 200, the door 200 returns to the first position by an urging force of the urging spring 103.

According to this configuration, similar to the first embodiment, the accessibility to the door 200 and the jam processing performance can be realized at the same time. Further, as described with respect to FIG. 6, the door 200 will be closed even if the user forgets to close the door, and damage to the door 200 and the sheet conveyance apparatus 300 can be reduced.

According to any of the embodiments described above, the urging spring 103 is provided between the pivot member 110 and the door, but the present invention is not restricted thereto. For example, a configuration can be adopted where the urging spring 103 is provided between the printer body 201A (including the stopper 232) and the door, and the pivot member 110 may be omitted. In this state, the urging force of the urging spring 103 is set to be balanced with the door positioned at the first position.

According to any of the above-described embodiments, the door is supported in an openable/closable manner on the printer body 201A, but the present invention is not restricted thereto. For example, a configuration can be adopted where a processing door supported in an openable/closable manner on the printer body 201A and capable of opening a re-conveyance path R is provided, and the above-described door (100 or 200) can be provided in an openable/closable manner to the processing door. Further, the printer body 201A should include at least one conveyance portion for conveying the sheets, such as the feed roller 9 or the retard roller 10, instead of the pickup roller 8, and configured such that the conveyance portion is exposed if the door is opened.

The above-described embodiments have been described based on the printer 201 adopting an electrophotographic system, but the present invention is not restricted thereto. For example, the present invention can be applied to an image forming apparatus adopting an ink-jet system that forms images on sheets by injecting ink through nozzles. Moreover, the present invention can be applied to an external sheet conveyance apparatus 300 or to a finisher that performs various processing such as punching and sorting of sheets.

Other Embodiments

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-206325, filed on Oct. 25, 2017, which is hereby incorporated by reference herein in its entirety.

What is claimed is:

1. An image forming system comprising:

an image forming apparatus;

a sheet conveyance apparatus configured to be attached detachably to the image forming apparatus and configured to convey a sheet to the image forming apparatus; and a guide configured to guide the sheet conveyance apparatus so as to be attached to the image forming apparatus, with the image forming apparatus comprising:

an apparatus body;

a conveyance portion provided in the apparatus body and configured to convey a sheet; and an image forming portion provided in the apparatus body and configured to form an image on the sheet conveyed by the conveyance portion;

a door openable with respect to the apparatus body around a pivot shaft, and configured to pivot to a closed position that is closed with respect to the apparatus body, to a first position that is opened with respect to the apparatus body, and to a second position that is opened further with respect to the apparatus body than the first position, the door being configured to expose the conveyance portion at both the first and second positions and being retained at the first position in a state where no external force is applied to the door; and;

an urging portion configured to urge the door toward the first position in a case where the door is positioned at the second position, and wherein the sheet conveyance apparatus comprises a pressing portion configured to press the door positioned at the first position toward the closed position in a case where the sheet conveyance apparatus is guided by the guide so as to be attached to the image forming apparatus.

2. The image forming system according to claim 1, wherein the door is positioned lower than the image forming portion.

3. The image forming system according to claim 1, wherein the door comprises a handle portion for an opening and closing operation of the door, the pivot shaft is positioned lower than a center position of the door in a vertical direction, and the handle portion is positioned above the center position.

4. The image forming system according to claim 1, further comprising:

a pivot member pivotably supported with respect to the apparatus body around the pivot shaft; and a regulating portion configured to regulate pivoting of the pivot member at a predetermined pivot angle with respect to the apparatus body in a case where the door is positioned at the first position, wherein the urging portion is provided between the door and the pivot member, and is configured to urge the door and the pivot member to approach each other so that the door and the pivot member are pivoted integrally with respect to the apparatus body, and wherein the door is pivoted relatively with respect to the pivot member against urging force of the urging portion while the door moves from the first position to the second position.

5. The image forming system according to claim 4, wherein the regulating portion comprises an elongated hole portion that is provided on the pivot member and configured to extend in a circumferential direction around the pivot shaft, and a projection that is provided on the apparatus body and configured to regulate pivoting of the pivot member by contacting an end portion of the elongated hole portion in the circumferential direction.

6. The image forming system according to claim 5, wherein the door comprises a first contact portion, the pivot member comprises a second contact portion configured to contact the first contact portion, and the urging portion is configured to urge the door and the pivot member such that the first contact portion and the second contact portion approach each other.

7. The image forming system according to claim 6, wherein the regulating portion is configured to regulate pivoting of the pivot member, that is pivoted integrally with the door, at a predetermined pivot angle in a case where the door is opened and reaches the first position, the urging portion is configured to generate urging force that is greater than a moment generated by own weight of the door in a state where the door is positioned at the first position, and the first contact portion and the second contact portion are configured to contact each other in a state where the door is positioned at the first position, and to be separated from each other in a state where the door is positioned at the second position.

8. The image forming system according to claim 6, wherein the regulating portion is configured to regulate the pivot member, that is pivoted integrally with the door, at a predetermined pivot angle in a state where the door is opened and reaches a third position that is closer to the apparatus body than the first position, the urging portion is configured to generate urging force equivalent to a moment generated by own weight of the door in a state where the door is positioned at the first position, and the first contact portion and the second contact portion are configured to contact each other in a state where the door is positioned at the third position, and to be separated from each other in a state where the door is positioned at both the first position and the second position.

9. The image forming system according to claim 6, wherein the pivot member comprises a third contact portion configured to contact the door positioned at the second position and regulate the door from opening beyond the second position.

* * * * *